United States Patent [19]

Yanagisawa

[11] Patent Number: 5,007,355

[45] Date of Patent: Apr. 16, 1991

[54] LEATHER OR SIMILAR WORK SEWING MACHINE HAVING FLAT-NEEDLE CONTROLLER AND SEWING METHOD BY USE OF THE SEWING MACHINE

[75] Inventor: Gennai Yanagisawa, Matsumoto, Japan

[73] Assignee: Kabushiki Kaisha Iida, Kawaguchi, Japan

[21] Appl. No.: 389,057

[22] Filed: Aug. 2, 1989

[30] Foreign Application Priority Data

Aug. 10, 1988 [JP] Japan ..... 63-198072

[51] Int. Cl.[5] ..... D05B 15/08; D05B 19/00

[52] U.S. Cl. ..... 112/54; 112/98; 112/121.11; 112/121.12; 112/221

[58] Field of Search ..... 112/28, 36, 54, 121.11, 112/121.12, 221, 222, 262.3, 266.1, 308, 309

[56] References Cited

U.S. PATENT DOCUMENTS

| | | | |
|---|---|---|---|
| 2,604,860 | 7/1952 | Farber | 112/98 |
| 2,824,533 | 2/1958 | Goosman | 112/222 |
| 3,986,468 | 10/1976 | Szostak et al. | 112/222 |
| 4,373,458 | 2/1983 | Dorosz et al. | 112/121.12 |
| 4,461,226 | 7/1984 | Tajima | 112/221 X |
| 4,574,718 | 3/1986 | Scholl et al. | 112/121.12 |
| 4,674,421 | 6/1987 | Iwase | 112/121.12 |

FOREIGN PATENT DOCUMENTS

| | | | |
|---|---|---|---|
| 21751 | 5/1985 | Japan | 112/121.11 |

*Primary Examiner*—Werner H. Schroeder
*Assistant Examiner*—Paul C. Lewis
*Attorney, Agent, or Firm*—Kane, Dalsimer, Sullivan, Kurucz, Levy, Eisele and Richard

[57] ABSTRACT

A sewing machine for leather or the like is provided with a flat needle holding bar supported for up/down movement. The needle holding bar is further supported for rotational movement and a control motor is provided to rotate the needle as required to cause the flat surface of the needle to be parallel to the direction in which the thread runs. To this end the needle is rotated after the needle penetrates the leather but before it reaches bottom dead center to a position in which the flat portion is in its normal position for the thread running direction and upper and lower threads are twisted together whereafter the needle is rotated again to be parallel to the thread running direction.

3 Claims, 4 Drawing Sheets

9
7
30
6
5
4
11

LEATHER OR SIMILAR WORK SEWING MACHINE HAVING FLAT-NEEDLE CONTROLLER AND SEWING METHOD BY USE OF THE SEWING MACHINE

BACKGROUND OF THE INVENTION

The present invention relates to a leather or similar work sewing machine having a flat-needle controlling device and a method of sewing a leather or similar work by use of such a sewing machine.

DESCRIPTION OF THE PRIOR ART

FIG. 3 is a perspective view showing a needle bar connected to a mechanism for up/down moving of a flat needle in a conventional computerized leather sewing machine. A needle bar 2 holding a flat needle 1, which is generally flat in cross-section at its forward end, is up/down movably supported by a bearing (not shown). A needle bar connecting bracket 3 fixed to the needle bar 2 is connected, through a connection bar, to a slider 5 which is up/down slidably received in a vertical guide 4. A crank arm boss 6 is rotatably supported on the connecting bar, and connected to a crank pin 9 of a crank 8 through a crank arm 7. The crank 8 is connected to a rotation driving portion (not shown). An X-Y table on which a work is to be put is provided under the flat needle 1, and a rotating hook complete 11 connected to a swinging oscillating shaft 10 is provided under the X-Y table at a position associated with the needle.

Generally, leather is sewed in such a manner that the flat needle 1 is lowered to penetrate the leather, and when the flat needle is slightly raised to a position within the rotating hook complete 11 after it passed the bottom center, a knotter causes slack of an upper thread 1*a* held by the flat needle 1 to pick up the upper thread and makes the upper thread twist with a lower 1*b*, thread to thereby perform a sewing-up operation while preventing the upper and lower threads from getting loose.

In the case where leather is decoratively sewed by means of such a computerized leather sewing machine, generally, sewing is made in a manner so that a thread is made to run in the direction of an elongated hole formed in the leather by the flat needle 1 when the flat needle 1 passes through the leather. This is because if the direction of the elongated hole formed in the leather and the thread running direction do not coincide with each other but cross each other, the elongated hole appears in addition to a stitch so that the stitch does not appear beautiful.

The needle bar 2 holding the flat needle 1 is however fixed in its circumferentially predetermined position as seen from FIG. 3. In order to make the direction of the elongated hole caused by the flat needle and the thread running direction coincident with each other, the operator of the sewing machine must continue the sewing operation while curving the leather by hand in the direction in which the thread is to be made to run. Accordingly, the work is very hard for the operator.

SUMMARY OF THE INVENTION

It is therefore an object of the present invention to eliminate the foregoing disadvantage in the prior art.

It is another object of the present invention to provide a leather sewing machine having a mechanism for automatically making a flat needle move in the direction parallel to the thread running direction, and a method of sewing leather by using such a leather sewing machine.

In a computerized leather sewing machine, it is impossible to change, in relation with a knotter, the circumferential position of the needle and the thread running direction when upper and lower threads are made to get twisted in a rotating hook complete.

According to a first aspect of the present invention, the leather or similar work sewing machine comprises a needle bar holding a flat needle and supported up/down movably, an up/down movement mechanism for up/down moving the needle bar, and a control means for controlling the movement of the flat needle, the flat-needle control means including: a circumferential position control means constituted by a needle-bar rotating means and a control motor connected to the needle-bar rotating means, for controlling the circumferential position of the flat needle, the needle-bar rotating means being provided on the needle bar at a portion thereof so as to rotate integrally with the needle bar while allowing the needle bar to move up/down; and a needle-bar holding means attached to a portion of the needle bar at which the up/down movement mechanism is connected to the needle bar so that the needle-bar holding means is connected the up/down movement mechanism and the needle-bar holding means performs up/down movement integrally with the needle bar while allowing the needle bar to rotate.

According to a second aspect of the present invention, the method of sewing leather or similar-work by using a sewing machine of the type as defined above according to the first aspect of the invention, comprises the steps of: rotating a flat needle so that a flat surface of the flat needle is made parallel to a thread running direction required in accordance with a previously programmed pattern; lowering the flat needle so that the flat needle penetrates a work; rotating the flat needle to a circumferential position thereof which is normal for the sewing machine in a period before the flat needle reaches a bottom dead center after the flat needle has penetrated the work; twisting the upper and lower threads with each other; rotating the flat needle again so that the flat surface of the flat needle is made parallel to the thread running direction required in accordance with the programmed pattern at that time; causing the flat needle to pass through the work to get out of the work; changing the direction of the needle in accordance with the requirement of the pattern; and repeating the above-mentioned steps.

According to a second aspect of the present invention, the method of controlling a circumferential position of a flat needle of a leather or similar work sewing machine, in which a circumferential position of a needle bar holding the flat needle is controlled by means of a computer-controlled motor connected to the needle bar so that a flat surface of the flat needle is made always parallel to the thread running direction required in accordance with a previously programmed pattern only when the flat needle passes through the work.

BRIEF DESCRIPTION OF THE DRAWINGS

Other features and advantages of the present invention will be apparent from the following description taken in connection with the accompanying drawings, wherein.

DETAILED DESCRIPTION OF PREFERRED EMBODIMENT

Figure 1:
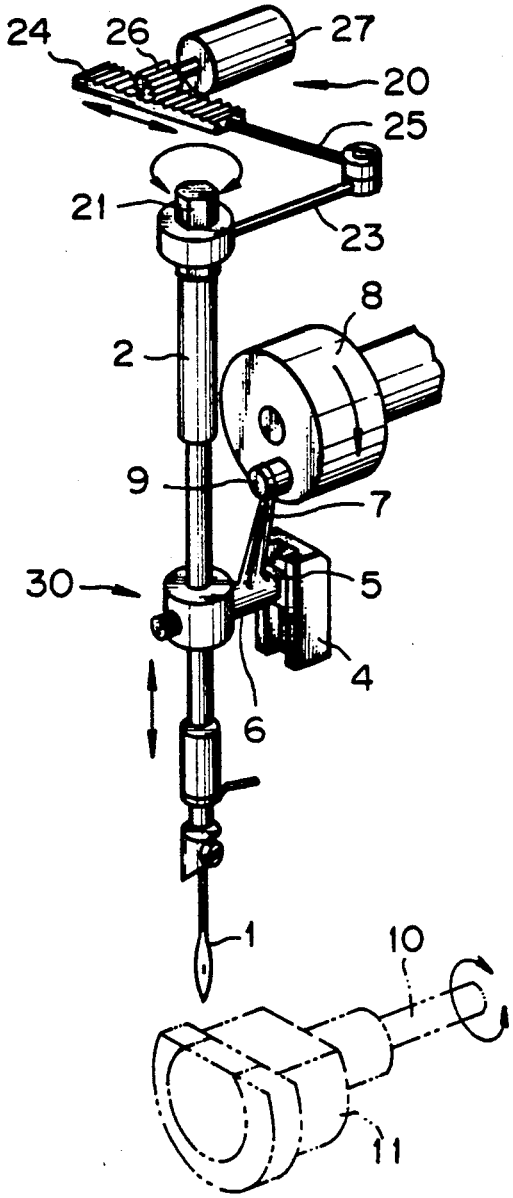
FIG. 1 is a perspective view of a needle bar of a computerized leather sewing machine having a flat-needle control device according to the present invention.

Referring to the drawings, an embodiment of the computerized sewing machine having the flat-needle control device according to the present invention will be described in detail hereunder.

Figure 3:
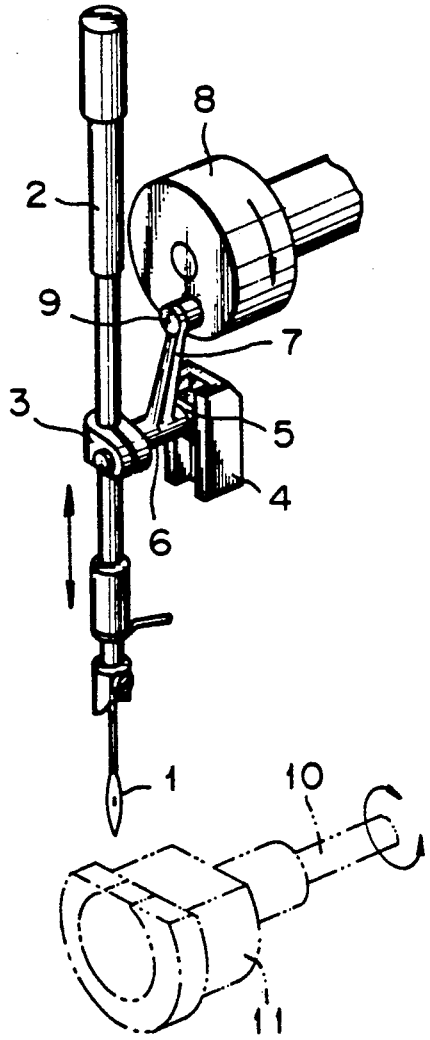
FIG. 3 is a perspective view of a needle bar of a conventional computerized leather sewing machine FIG. 4. is a plan view of material on an X-Y table showing the relationship between the flat needle direction and the thread running direction.
Figure 4:
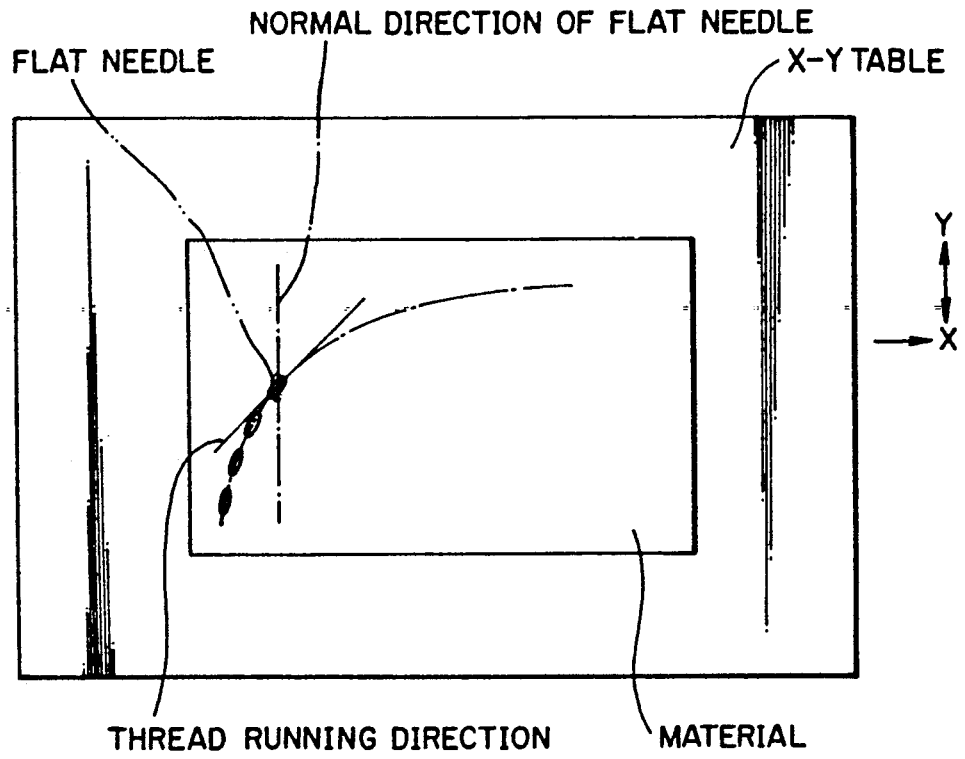
Figures 5A, 5B, 5C, 5D, 5E:
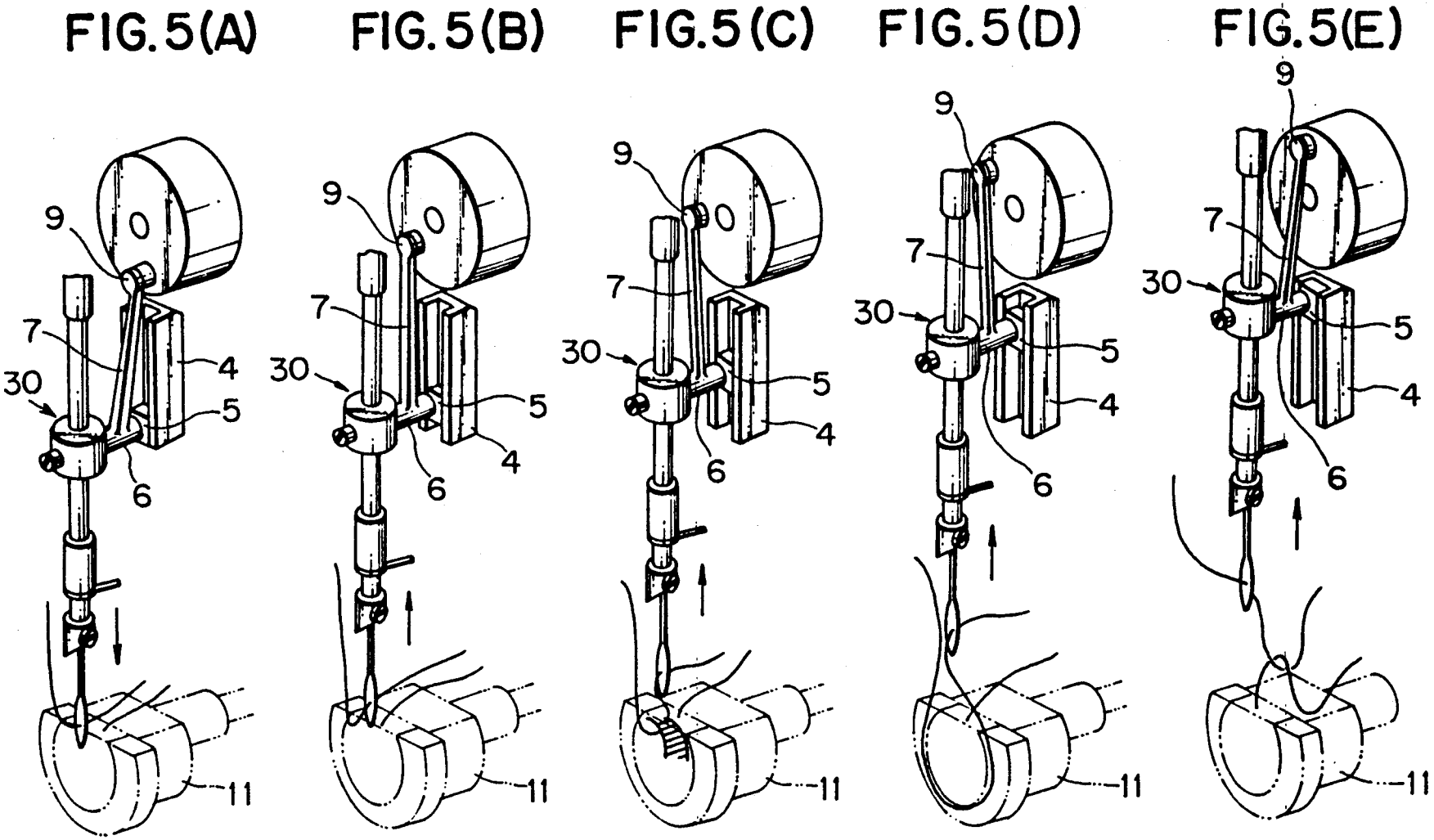
FIGS. 5(*a*) through 5(*e*) are fragmentary perspective views similar to FIG. 1 showing the twisting of the upper and lower threads with each other within the rotating hook.

FIG. 1 is a perspective view of a needle bar 2 of a computerized leather sewing machine having a flat-needle control device according to the present invention. In FIG. 1, the parts the same as or equivalent to those in FIG. 3 are correspondingly referenced.

The flat-needle control device according to the present invention has a flat-needle circumferential position control mechanism 20. The control mechanism 20 is configured in a manner so that a portion 21 having a polygonal cross-section is formed on the top of the up/down movable needle bar 2 of an ordinary computerized leather sewing machine, a cylindrical body 22 having a hole having a polygonal cross-section complementarily the same as that of the polygonal portion 21 is up/down movably fitted onto the polygonal portion 21, a connecting bar 23 connected to the cylindrical body 22 and a connecting bar 25 connected to a rack 24 are pivoted to each other, and a pinion 26 fixed to an output shaft of a computer-controlled motor 27 is engaged with the rack 24. Although a polygonal cross-section is used as a needle-bar rotating means which rotates together with the needle bar 2 while allowing the needle bar 2 to up/down move in this embodiment, a spline may be used for the same purpose.

Figure 2:
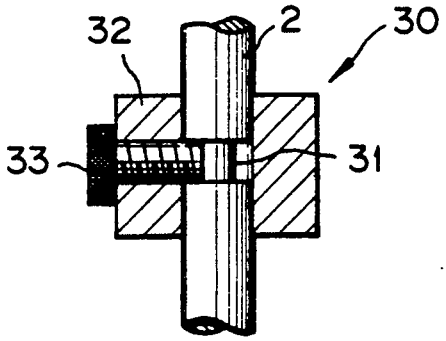
FIG. 2 is an enlarged sectional view of a connecting portion of a needle bar and an up/down moving mechanism of the needle bar.

As shown in FIG. 2, the flat-needle control device according to the present invention is further provided, in place of the conventional needle bar connecting bracket 3 fixed to the needle bar 2 (FIG. 3), with a needle-bar holding means 30 which up/down moves together with the needle bar 2 while allowing the needle bar 2 to rotate. The needle-bar holding means 30 is configured in a manner so that an annular groove 31 is formed in the needle bar 2, a cylindrical body 32 is fitted onto the needle bar 2, and a set screw 33 is screwed into the cylindrical body 32 from the outside thereof so that the forward end portion of the set screw is inserted into the annular groove 31. Similarly to the conventional device, the cylindrical body 32 is of course connected to a slider 5 through a connecting bar, and a boss 6 of a crank arm 7 is fitted on the connecting bar.

The method of sewing leather or a similar work by using the computerized leather sewing machine having the flat-needle control device having the above configuration will be described.

When a work is moved on an X-Y table in accordance with a previously programmed pattern, a command of a quantity of rotating angles of the computer-controlled motor 27 necessary for making the flat surface of the flat needle parallel to the thread running direction required in accordance with the program is given by the computer to the computer-controlled motor 27, so that the motor 27 rotates by the quantity of rotating angles in accordance with the command to move the rack 24 so as to rotate the cylindrical body 22 through the connecting bars 25 and 23 pivoted to each other to thereby rotate the needle bar 2 by the rotating angles required according to the program. Then, the flat needle 1 is lowered so as to penetrate the work, the flat needle 1 is rotated to a circumferential position thereof which is normal for the sewing machine in a period before the flat needle reaches a bottom dead center after the flat needle has penetrated the work. After the upper and lower threads are made to get twisted with each other, a rotating command is given to the computer-controlled motor 27 so that the motor 27 rotates the needle bar 2 by a quantity of rotating angles required according to the program at that time so as to make the flat surface of the flat needle 1 parallel to the thread running direction again. Then, the flat needle 1 is caused to pass through the work to get out of the work. Next, according to the requirement of the programmed pattern, the circumferential position of the flat needle 1 is changed in the same manner as described above and the foregoing operation is repeated.

In the leather or similar-work sewing machine having the flat-needle control device according to the first aspect of the present invention, the circumferential position of the flat needle can be automatically controlled in sewing operation so that the flat surface of the flat needle is made always parallel to the thread running direction, and the flat-needle control device is configured so that it can be easily incorporated into a previously existing needle bar, so that there is an advantage that the cost for manufacturing and assembling is not much required.

In the method of sewing a work by using of the sewing machine having the flat-needle control device according to a second aspect of the present invention, the flat surface of the flat needle is made parallel to the thread running direction when the flat needle passes through the work, and the direction of the flat needle is returned to the normal position when upper and lower threads are made to get twisted with each other in the rotating hook complete. Accordingly, the flat needle is rotated so as to become parallel to the thread running direction without affecting the normal operation of the sewing machine for making the upper and lower threads to get twisted with each other, so that apparently fine stitches can be automatically finished.

What is claimed is:

1. A sewing machine for leather comprising a needle bar holding a flat needle and supported for movement up and down, and up/down movement mechanism for up/down moving said needle bar, and a control means for controlling the movement of said flat needle, said flat-needle control means including:

a circumferential position control means comprising a needle-bar rotating means and a control motor connected to said needle-bar rotating means for controlling a circumferential position of said flat needle, said needle-bar rotating means being provided on said needle bar at a portion thereof so as to rotate integrally with said needle bar while allowing said needle bar to move up and down; and a needle bar holding means attached to a portion of said needle bar where said up/down movement mechanism is connected to said needle bar so that said needle-bar holding means is connected to said up/down movement mechanism and said needle-bar holding means moves up/down integrally with said needle bar while allowing said needle bar to rotate.

2. A method of sewing leather with a sewing machine in accordance with a preprogrammed pattern comprising the steps of:

rotating a flat needle having an upper thread so that a flat surface of said flat needle is made parallel to a thread running direction required in accordance with said pattern;

lowering said flat needle so that said flat needle penetrates a work;

rotating said flat needle if required by said pattern to a circumferential position thereof which is normal for said sewing machine in a period before said flat needle reaches a bottom dead center within a stationary rotating hook having a lower thread after said flat needle has penetrated said work;

using said rotating hook to twist said upper and lower threads with each other.

rotating said flat needle again so that said flat surface of said flat needle is made parallel to the thread running direction in accordance with said pattern at that time;

causing said flat needle to pass through said work to be free of said work;

rotating said needle in accordance with the requirements of said pattern; and repeating the above mentioned steps as required by said pattern.

3. A method of controlling a circumferential position of a flat needle of a sewing machine for leather comprising the step of rotating a needle bar holding said flat needle as controlled by means of a computer-controlled motor connected to said needle bar so that a flat surface of said flat needle is always made parallel to a thread running direction required in accordance with a previously programmed pattern only when said flat needle passes through said work.

* * * * *